United States Patent [19]

Takahashi et al.

[11] Patent Number: 5,073,764

[45] Date of Patent: Dec. 17, 1991

[54] CURRENT LIMITING APPARATUS

[75] Inventors: Mitsugu Takahashi; Yoshiaki Kobayashi; Takao Mitsuhashi, all of Amagasaki; Shinji Yamagata, Fukuyama, all of Japan

[73] Assignee: Mitsubishi Denki Kabushiki Kaisha, Tokyo, Japan

[21] Appl. No.: 583,318

[22] Filed: Sep. 17, 1990

[30] Foreign Application Priority Data

| | | | |
|---|---|---|---|
| Sep. 18, 1989 | [JP] | Japan | 1-241343 |
| Sep. 18, 1989 | [JP] | Japan | 1-241346 |
| Sep. 18, 1989 | [JP] | Japan | 1-241347 |
| Sep. 18, 1989 | [JP] | Japan | 1-241348 |
| Sep. 18, 1989 | [JP] | Japan | 1-241354 |
| Jun. 27, 1990 | [JP] | Japan | 2-171903 |

[51] Int. Cl.[5] ..... H01H 75/00

[52] U.S. Cl. ..... 335/16; 335/147; 335/202; 200/144 R

[58] Field of Search ..... 335/8–10, 335/16, 147, 195, 202; 200/144 R, 147 R

[56] References Cited

U.S. PATENT DOCUMENTS

| | | | |
|---|---|---|---|
| 3,106,627 | 3/1960 | Lisnay | 200/144 R |
| 4,346,357 | 8/1982 | Kussy et al. . | |
| 4,713,635 | 12/1987 | Flick et al. | 335/8 |
| 4,945,327 | 7/1990 | Doughty et al. | 335/16 |

FOREIGN PATENT DOCUMENTS 57-45007 9/1982 Japan .

*Primary Examiner*—Leo P. Picard
*Assistant Examiner*—Lincoln Donovan
*Attorney, Agent, or Firm*—Burns, Doane, Swecker & Mathis

[57] ABSTRACT

In a twin-contact type current limiting apparatus in which two contacts are electrically connected in series with each other, each of movable contact arms (23*a*, 23*b*) is extended in substantially parallel with and along each of stationary contact arms (21*a*, 18*a*), thereby obtaining balanced electromagnetic repulsions when an excessive current flows.

8 Claims, 15 Drawing Sheets

CURRENT LIMITING APPARATUS

FIELD OF THE INVENTION AND RELATED ART STATEMENT

1. Field of the Invention

The present invention relates to a current limiting apparatus which has two movable contacts per one phase in order to improve current limiting performance.

2. Description of the Related Art

FIGS. 14 and 15 are perspective views showing the conventional current limiting apparatus disclosed in, for example, the Japanese examined patent publication (Tokko)Sho 57-45007. This apparatus is used in an opening/closing section of a circuit breaker.

In these figures, a casing 1 is made of an insulating material. A first stationary conductor 2 consists of a stationary contact arm 4 and a connection conductor 5. A stationary contact 3*a* is formed on an end part of the stationary contact arm 4 to oppose against a movable contact 7*a* which is fixed to an end of a first movable contact arm 6*a*. Similarly, a second movable contact arm 6*b* has a movable contact 7*b* fixed at an end thereof. These movable contact arms 6*a* and 6*b* are connected with each other via a flexible conductor 8. A second stationary conductor 9 consists of a stationary contact arm 10 and a connection conductor 11. A stationary contact 3*b* is formed on an end part of the stationary contact arm 10 to oppose against the movable contact 7*b*. The first stationary conductor 2 and the second stationary conductor 9 are disposed nearly horizontally with respect to the bottom surface 1*a* of the casing 1 and are extended in opposite directions to each other across the stationary contacts 3*a* and 3*b*. Both the movable contact arms 6*a* and 6*b* are fixed to a pin 12 which is rotatably held by a side wall part 1*b* (only one is shown) of the casing 1. Both the movable contact arms 6*a* and 6*b* are urged by springs 13*a* and 13*b* to give a predetermined contacting pressure to both the movable contacts 7*a* and 7*b*, respectively. Between the first movable contact arm 6*a* and the second movable contact arm 6*b*, there is provided a barrier board 14 of the insulating material. Hot gas of arcs, which are generated between the stationary contact 3*a* and the movable contact 7*a* and between the stationary contact 3*b* and the movable contact 7*b*, is exhausted through many holes 15*a* formed in a partition board 15 of the insulating material.

Next, operation of the above-mentioned current limiting apparatus is described. In a closed state, a pair of movable contact arms 6*a* and 6*b* are biased by the springs 13*a* and 13*b* so that the movable contacts 7*a* and 7*b* make contact with the stationary contacts 3*a* and 3*b* with a predetermined contacting pressure, respectively. At that time, under the state that the first connection conductor 5 is connected to the power source and the second connection conductor 11 is connected to the load, current flows from the first connection conductor 5 to the second connection conductor 11 through the first stationary contact arm 4, the first movable contact arm 6*a*, the flexible conductor 8, the second movable contact arm 6*b* and the second stationary contact arm 10 in this sequential order. Flowing directions of this current are shown by arrows $I_1$–$I_7$ in FIG. 14.

When a large current flows at the time of shortcircuit, a tripping mechanism (not shown) of the circuit breaker operates to rotate both the movable contact arms 6*a* and 6*b*. Both the movable contacts 7*a* and 7*b* are thereby disconnected from the stationary contacts 3*a* and 3*b*, respectively. At that moment, substantially two arcs are generated between the first stationary contact 3*a* and the first movable contact 7*a* and also between the second stationary contact 3*b* and the movable contact 7*b*. Since the second movable contact arm 6*b* and the second stationary contact arm 10 are disposed in substantially parallel with each other with the opposite current-flowing directions ($I_5$ and $I_6$) to each other, electromagnetic repulsion acts on the movable contact arm 6*b* to accelerate its opening motion.

In the above-mentioned construction, "two" arcs are generated, thereby making high arc voltage of approximately two times as large as that of only one arc in the generally-used current breaking apparatus having only one movable contact. As a result, fault current is effectively limited by the high arc voltage, thus realizing high current-limiting performance. The arcs are cooled in a first arc-extinguishing chamber 101 and a second arc-extinguishing chamber 102, and the hot gas is exhausted out of the casing 1 through the holes 15*a*.

In the above-mentioned current limiting apparatus, since the second movable contact arm 6*b* receives the electromagnetic force in addition to a force of the tripping mechanism, breaking action of the second movable contact 7*b* with arc precedes that of the first movable contact 7*a*. Therefore, the second movable contact 7*b*, the second stationary contact 3*b* and the second arc-extinguishing chamber 102 are damaged severely in comparison with the first movable contact 7*a*, the first stationary contact 3*a* and the first arc-extinguishing chamber 101. As a result, failure of conduction occurs between the second stationary contact 3*b* and the second movable contact 7*b*, or insulating ability of the insulating part lowers. In order to avoid these undesirable states, it is possible to use special contacts and a special arc-extinguishing chamber. However, such special construction is expensive.

Further, since the breaking motions of the first movable contact arm 6*a* and the second movable contact arm 6*b* are not synchronized with each other, the flexible conductor 8 and the pin 12 receive torsion force, thereby resulting in their deformation. Although the conductor 8 is "flexible", it is not very flexible due to its thickness. Therefore, once the flexible conductor 8 becomes deformed, the deformation remains after the torsion force is removed. Both the movable contacts 6*a* and 6*b* are thus deprived of their normal opening/closing motions.

OBJECT AND SUMMARY OF THE INVENTION

An object of the present invention is to offer a current limiting apparatus which can reduce the above-mentioned damages and deformation caused by unbalanced motion of a pair of movable contact arms at the time of shortcircuit etc., and besides, to realize the current limiting apparatus having an excellent current limiting ability in a compact and low-priced construction.

In order to achieve the above-mentioned object, the current limiting apparatus of the present invention comprises:

a casing;

a first stationary contact arm which is fixedly mounted in the casing and has a first stationary contact;

a first movable contact arm which is pivotally mounted in the casing and has a first movable contact, the first movable contact arm being urged to press said first movable contact against the first stationary contact and extended in substantially parallel with and along the first stationary contact arm;

a second stationary contact arm which is fixedly mounted in the casing and has a second stationary contact; and a second movable contact arm which is pivotally mounted in the casing and has a second movable contact, the second movable contact arm being urged to press the second movable contact against second stationary contact and extended in substantially parallel with and along the second stationary contact arm, and being electrically connected in series with the first movable contact arm.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DESCRIPTION OF THE PREFERRED EMBODIMENT

Hereafter, preferred embodiments of the present invention are described with reference to the accompanying drawings.

Figure 1:
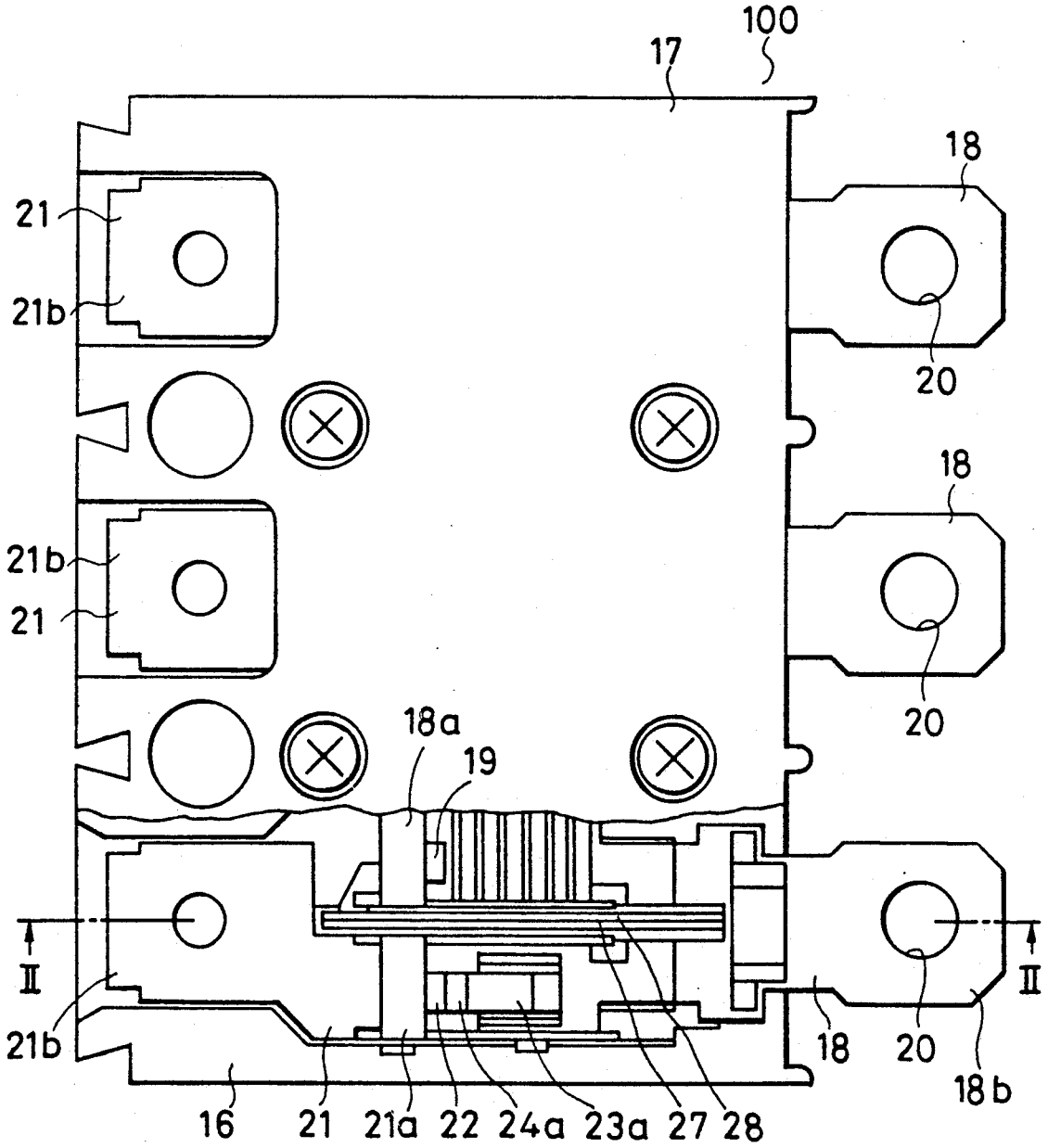
FIG. 1 is a front view showing a current limiting apparatus of a first embodiment of the present invention.
Figure 2:
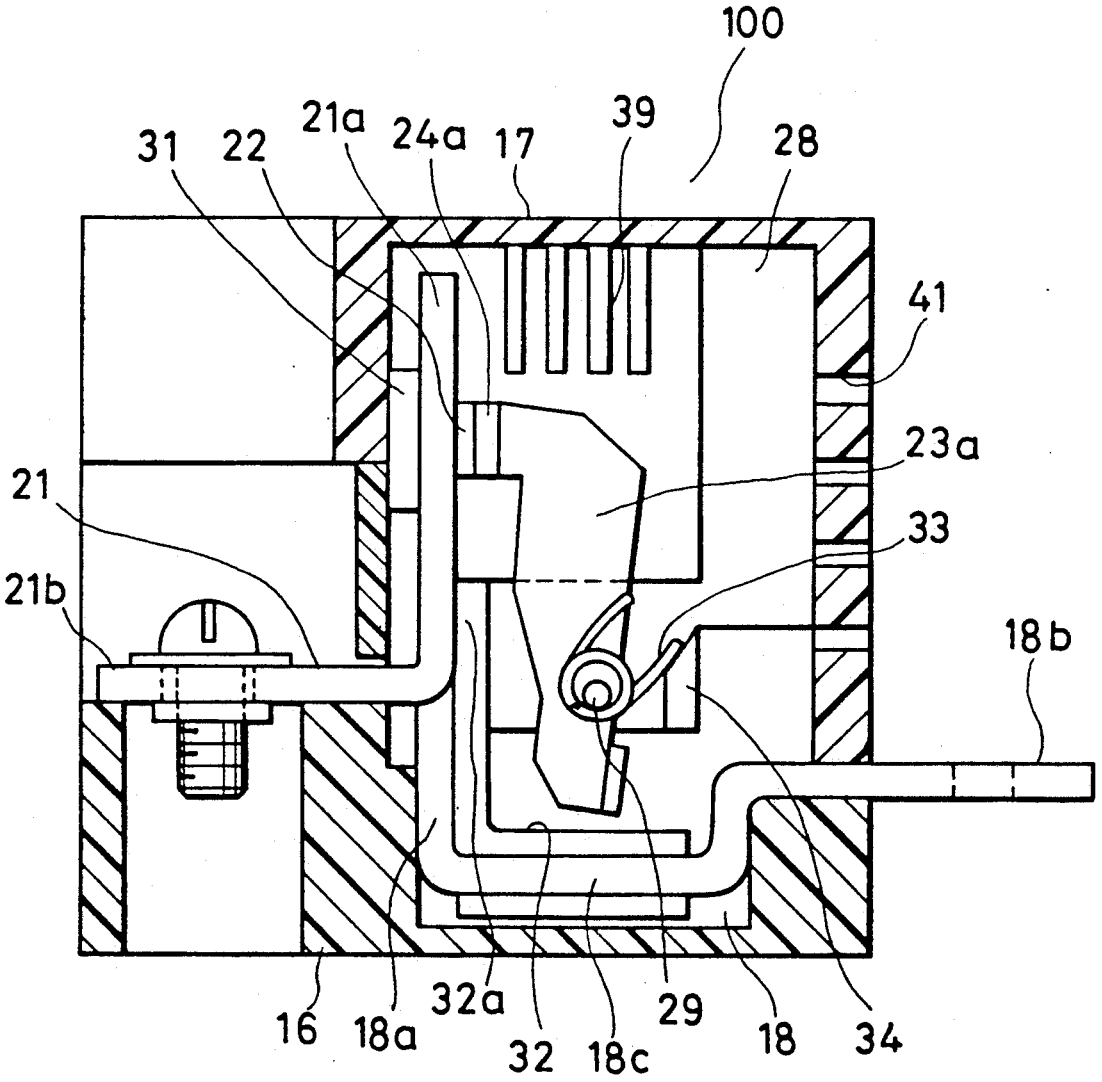
FIG. 2 is a cross-sectional side view showing the current limiting apparatus taken on line II—II in FIG. 1.
Figure 3:
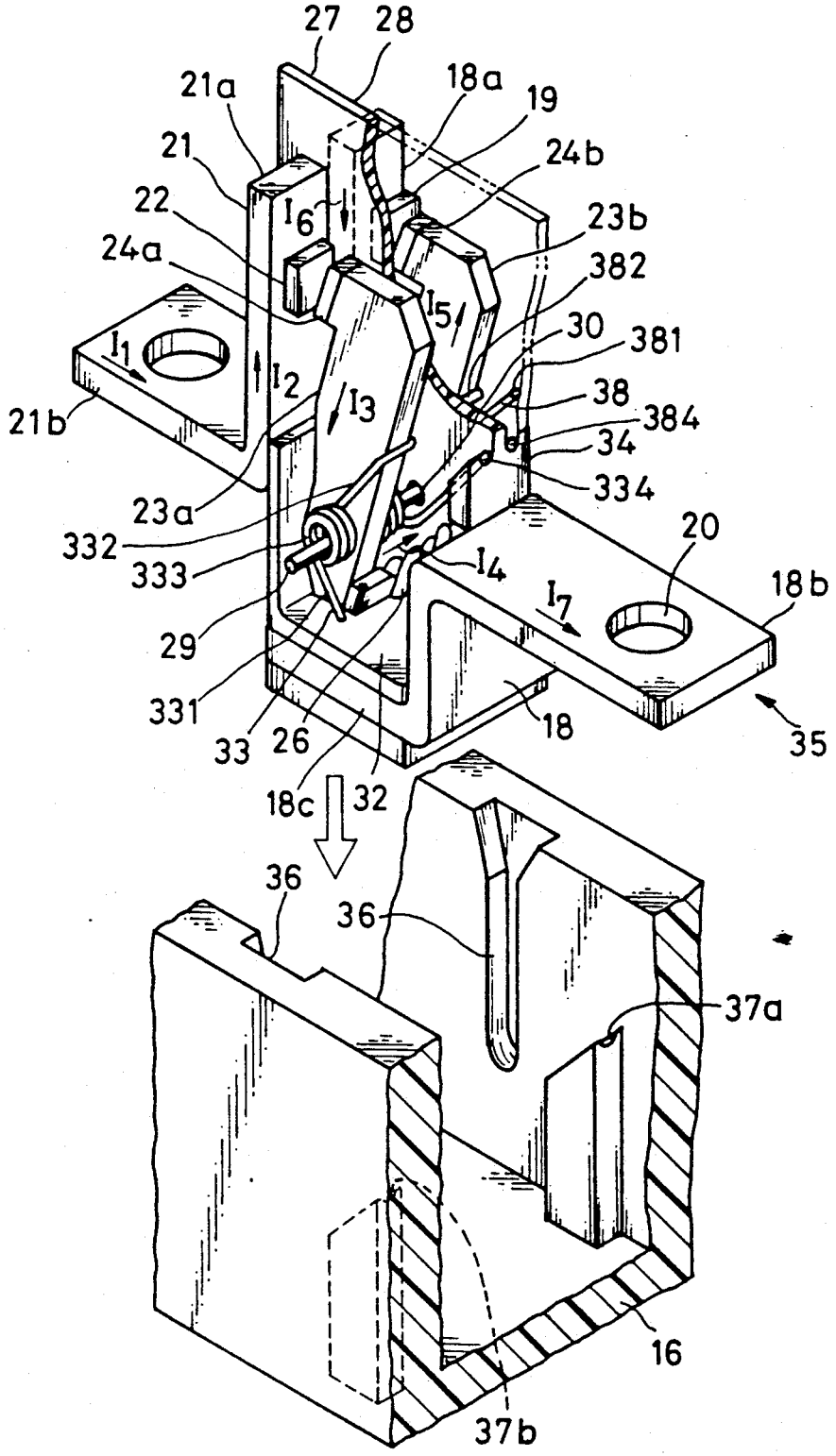
FIG. 3 is a perspective view showing main mechanical parts of the current limiting apparatus in FIG. 1 or FIG. 2.
Figure 4:
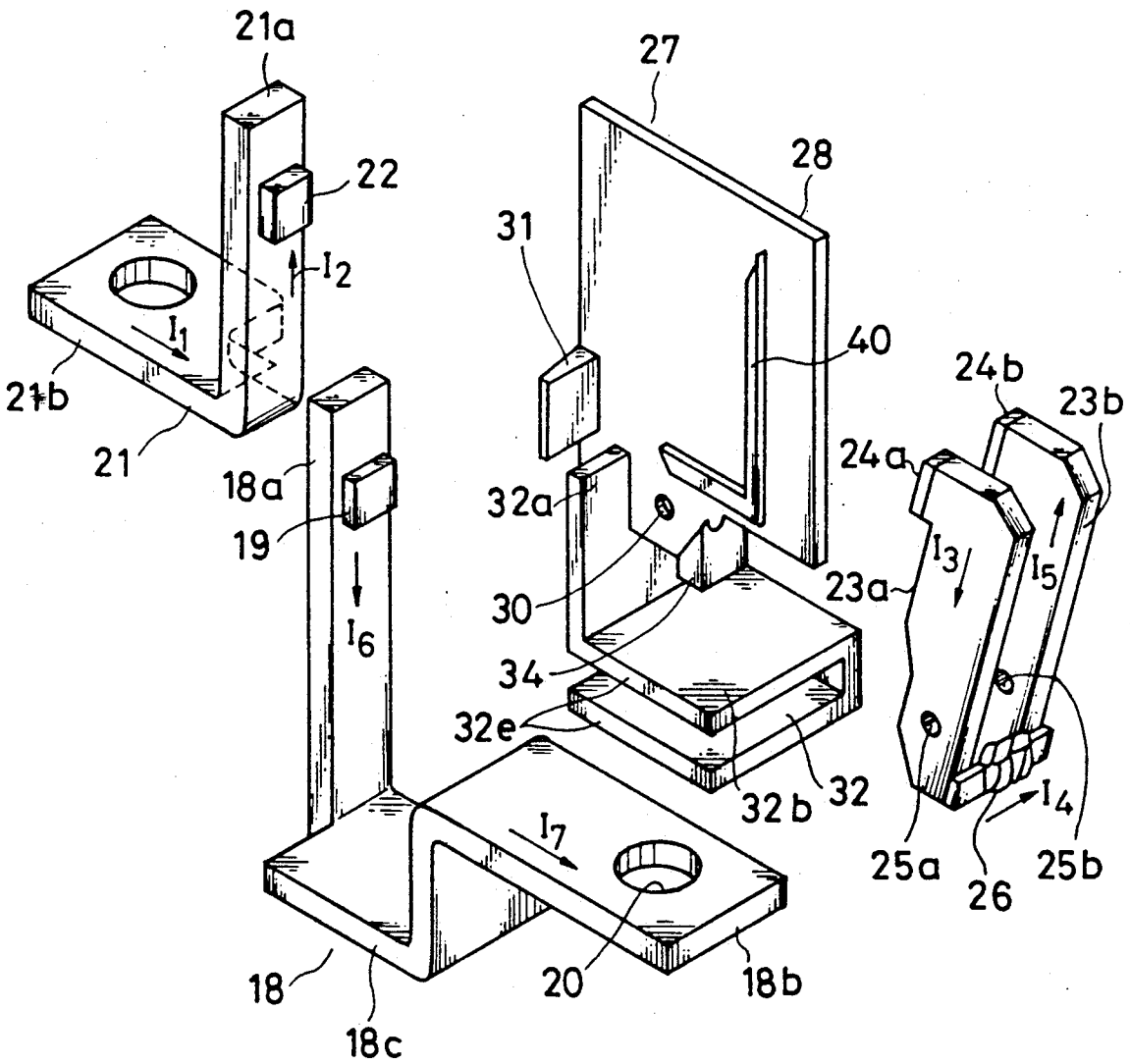
FIG. 4 is a perspective view showing the main mechanical parts of FIG. 3 taken all to pieces.

FIG. 1 is a front view showing a current limiting apparatus 100, and FIG. 2 is a cross-sectional side view taken on line II—II in FIG. 1. FIG. 3 is a perspective view showing main mechanical parts of the current limiting apparatus 100 in FIGS. 1 and 2, and FIG. 4 is a perspective view taken all to pieces. In these figures, a casing 16 and a cover 17 are made of an insulating material. A first stationary conductor 18(FIG. 4) is formed into substantially L-shaped with a vertically(in FIG. 4) extended first stationary contact arm 18*a* and a horizontally extended first connecting arm 18*b*. The first stationary contact arm 18*a* has a stationary contact 19 thereon. From a bottom part 18*c* toward the first connecting arm 18*b*, the first stationary conductor 18 is bent to form a stairs-shaped configuration of a certain height, and the first connecting arm 18*b* having a connection hole 20 is projected out of the casing 16. A second stationary conductor 21(FIG. 4), which is formed into L-shaped, has a vertically extended second stationary contact arm 21*a* and a horizontally extended second connecting arm 21*b*. The second stationary contact arm 21*a* has a stationary contact 22 thereon. A pair of movable contact arms 23*a* and 23*b*(FIG. 4) are provided in a manner to oppose in substantially parallel with the stationary contact arms 21*a* and 18*a*, respectively. The movable contact arms 23*a* and 23*b* are electrically connected with each other by a flexible copper-stranded wire 26 at each one end thereof. A pair of movable contacts 24*a* and 24*b* are fixed on the other end of the movable contact arms 23*a* and 23*b*, respectively. The movable contact arms 23*a* and 23*b* have a pair of holes 25*a* and 25*b*, respectively. An insulating frame 27(FIG. 4), which includes an insulating wall 28, a projection 31 and an engaging part 32, is made of an insulating material. The movable contact arms 23*a* and 23*b* stand next to each other across the insulating wall 28 and pivotally held by a pin 29 (FIG. 3) getting through the hole 25*a*, 25*b* and a hole 30 formed in the insulating wall 28. Also, the stationary contact arms 18*a* and 21*a* stand next to each other across the insulating wall 28. The engaging part 32,.which is of U-shaped, is put on the bottom part 18*c* in a manner to sandwich the bottom part 18*c* between a pair of holding members 32*e*, thereby being fixedly held by the bottom part 18*c*. As a result of the assembling, the insulating wall 28 is fixed on the bottom part 18*c*. The projection 31, which is protrudently formed on the insulating wall 28, and another projection 32*a*, which is vertically extended from an end of the engaging part 32, are disposed to oppose to each other with a predetermined gap therebetween in the horizontal direction. The second stationary contact arm 21*a* is put between both the projections 31 and 32*a*. A torsion spring 33(FIG. 3) is provided to urge the second movable contact arm 23*a* to rotate counterclockwise. A coil part 333 of the torsion spring 33 is put on around the pin 29. One end 331 of the torsion spring 33 is received by a spring stopper 37*b* formed on the casing 16, and the other end 334 is received by a spring stopper 34 formed on the insulating wall 28. An intermediate part 332 of the torsion spring 33 is engaged with a rear wall part of the second movable contact arm 23*a*, thereby giving a predetermined contacting pressure to the second movable contact arm 23a and the second movable contact 24a. Similarly, one end of the torsion spring 38 is received by a spring stopper 37a formed on the casing 16, and the other end 384 is received by the spring stopper 34. An intermediate part 382 of the torsion spring 38 is engaged with a rear wall part of the first movable contact arm 23b, thereby giving a predetermined contacting pressure to the first movable contact arm 23b and the first movable contact 24b.

Assembly procedure of a current limiting unit 35 (FIG. 3) is as follows. First, both the movable contact arms 23a, 23b and both the torsion springs 33, 38 are held around the pin 29, and the pin 29 is held by the insulating wall 28. Next, the insulating frame 27, on which the first and second movable contact assemblies are mounted, is fixed onto the first stationary conductor 18 by sandwiching the bottom part 18c with the engaging part 32 without any fixing screws.

The current limiting unit 35 assembled by the above-mentioned procedures is mounted on the casing 16 with both ends of the pin 29 inserted into a pair of bearing grooves 36. Both ends of the pin 29 are thus caught in a pair of bearing grooves 36, and a center part of the pin 29 is caught in the hole 30 of the insulating wall 28. The bearing grooves 36 serve not only to hold the pin 29 but also to guide it at the time of assembly. When the pin 29 is inserted to the bottom of the bearing grooves 36, motion of the pin 29 in X-direction of FIG. 3 is restricted by the bearing grooves 36 in cooperation with the hole 30. Motion of the pin 29 in Y-direction of FIG. 3 is also restricted by the hole 30 of the insulating wall 28. Thus, the pin 29 is tightly held by the insulating wall 28 and the casing 16, and a fulcrum of the movable contact arms 23a and 23b is fixed. Contacting states of the movable contacts 24a and 24b with the respective stationary contacts 22 and 19 are thereby made stable. Since a force applied to the pin 29 at the detaching motion of the movable contact arms 23a and 23b is received by the bearing grooves 36 formed in a thick wall part of the casing 16, an excessive force does not act on the comparatively thin insulating wall 28. By inserting the current limiting unit 35 onto the casing 16, the end 331 of the torsion spring 33 and the end 381 of the torsion spring 38 abut on the spring stoppers 37b and 37a, respectively, and are fixedly supported thereon automatically. Thus, the current limiting unit 35 is fixedly mounted on the casing 16.

Next, the stationary conductor 21 is put between the projections 31 and 32a and fixed thereat. An arc-extinguishing unit 39 (FIG. 2) is fixedly held by a stopper 40 (FIG. 4). Further, the cover 17 (FIG. 2) is fixed on the casing 16 from upside. Plural exhaust holes 41 (FIG. 2) are formed in the cover 17 and behind a pair of movable contact arms 23a and 23b.

Figure 5:
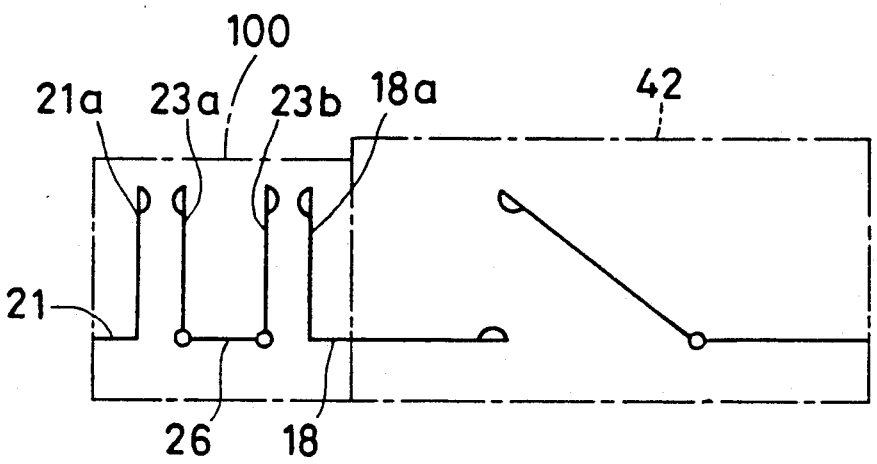
FIG. 5 is an illustration showing a block skeleton diagram of a circuit breaker 42 coupled with the current limiting apparatus 100.

FIG. 5 is an illustration showing a block skeleton diagram of a circuit breaker 42 coupled with the current limiting apparatus 100. The current limiting apparatus 100 is electrically connected in series with the circuit breaker 42.

Next, operation of the above-mentioned current limiting apparatus is described with reference to FIG. 3. In a closed state of the current limiting apparatus, the movable contact arms 23a and 23b are urged to pushingly make the movable contacts 24a and 24b in contact with the stationary contacts 22 and 19, respectively. A current passage in the closed state is from the second stationary conductor 21 to the first stationary conductor 18, through the second stationary contact arm 21a including the second stationary contact 22, the second movable contact arm 23a including the second movable contact 24a, the flexible copper-stranded wire 26, the first movable contact arm 23b including the first movable contact 24b and the first stationary contact arm 18a including the first stationary contact 19 in this order. At that time, since direction of a current $I_3$ flowing through the second movable contact arm 23a and direction of a current $I_2$ flowing through the second stationary contact arm 21a are opposite to each other, electromagnetic repulsion acts on these contact arms 23a and 21a to each other. In a normal current level, this electromagnetic repulsion is weaker than a biasing force of the torsion spring 33, thereby holding the movable contact 24a in contact with the stationary contact 22. Similarly, since direction of a current $I_5$ flowing through the first movable contact arm 23b and direction of a current $I_6$ flowing through the first stationary contact arm 18a are opposite to each other, electromagnetic repulsion acts on these contact arms 23b and 18a to each other. In a normal current level, this electromagnetic repulsion is weaker than a biasing force of the torsion spring 38, and thereby the movable contact 24b remains in contact with the stationary contact 19.

When a flowing current exceeds a predetermined value due to shortcircuit etc., the electromagnetic repulsions acting on the movable contact arms 23a and 23b overcome the biasing forces of the torsion springs 33 and 38, respectively. At that moment, both the movable contacts 24a and 24b are nearly simultaneously detached from the stationary contacts 22 and 19 with arcs generated therebetween, respectively. Further, two movable contact arms 23a and 23b rotate to open in high speed, thereby elongating the arcs. Each of the elongated arcs holds a high arc voltage and is cooled by the cooling effect of the arc-extinguishing unit 39 (FIG. 2). Opening actions of the movable contact arms 23a and 23b are carried out without waiting for tripping action of the circuit breaker 42 (FIG. 5).

In the above-mentioned opening action carried out in the current limiting apparatus, the electromagnetic repulsions act on both the movable contact arms 23a and 23b equally to each other, and the two arcs are generated at the same time in substance. Accordingly, two arc-energies generated by the two arcs are nearly equal to each other. As a result, wear of contacts and damages of the arc-extinguishing chamber, both of which are caused by the arc, are nearly equal to each other, and degrees of the wear and the damages are reduced in comparison with those in case where the greater part of the arc-energy is concentrated on one side of the arc-extinguishing chamber. Moreover, since opening motions of the movable contact arms 23a and 23b are nearly synchronous, the movable contact arms 23a and 23b make smooth motions without any deformation (twist etc.) of the mechanical parts such as the pin 29.

Besides, since all the stationary contact arms 18a and 21a and the movable contact arms 23a and 23b are vertically arranged in the current limiting apparatus 100, a horizontal length (a length in the primary-secondary direction) of the current limiting apparatus 100 is shortened.

Hereupon, location of the exhaust holes 41(FIG.2) is one of important problems in the current limiting apparatus. This is because hot gas generated by the two arcs in the casing 16 is apt to cause dielectric breakdown between the conductors or may injure a human body. In the above-mentioned current limiting apparatus 100, however, the exhaust holes 41 are not formed in the upper part but in the side wall part of the cover 17 and the casing 16, so that the hot gas is exhausted out of the cover 17 toward right in FIG. 2. This contributes not only to the safety for the operator, who can access the current limiting apparatus 100 only from upside in FIG. 2, but also to the prevention of dielectric breakdown between the first stationary contact arm 18*a* and the second stationary contact arm 21*a*. The reason of the latter is that the hot gas moves away from the stationary contact arms 18*a* and 21*a*, which have a high voltage difference from each other at the time of occurrence of two arcs, and passes beside the movable contact arms 23*a* and 23*b* which have the same potential to each other.

In the above-mentioned current limiting unit 35, dielectric strength is secured as follows. That is, the dielectric strength between the first stationary contact arm 18*a* and the second stationary contact arm 21*a* is increased by the insulating wall 28 and the projection 31 (FIG.4), and the dielectric strength between a pair of movable contact arms 23*a* and 23*b* is increased by the insulating wall 28. Further, the dielectric strength between the movable contact arm 23*a*(or 23*b*) and the first stationary conductor 18 is increased by the projection 32*a* and the engaging part 32. This construction for increasing the dielectric strength is realized only by mounting the insulating frame 27 onto the first stationary conductor 18.

Figure 4A:
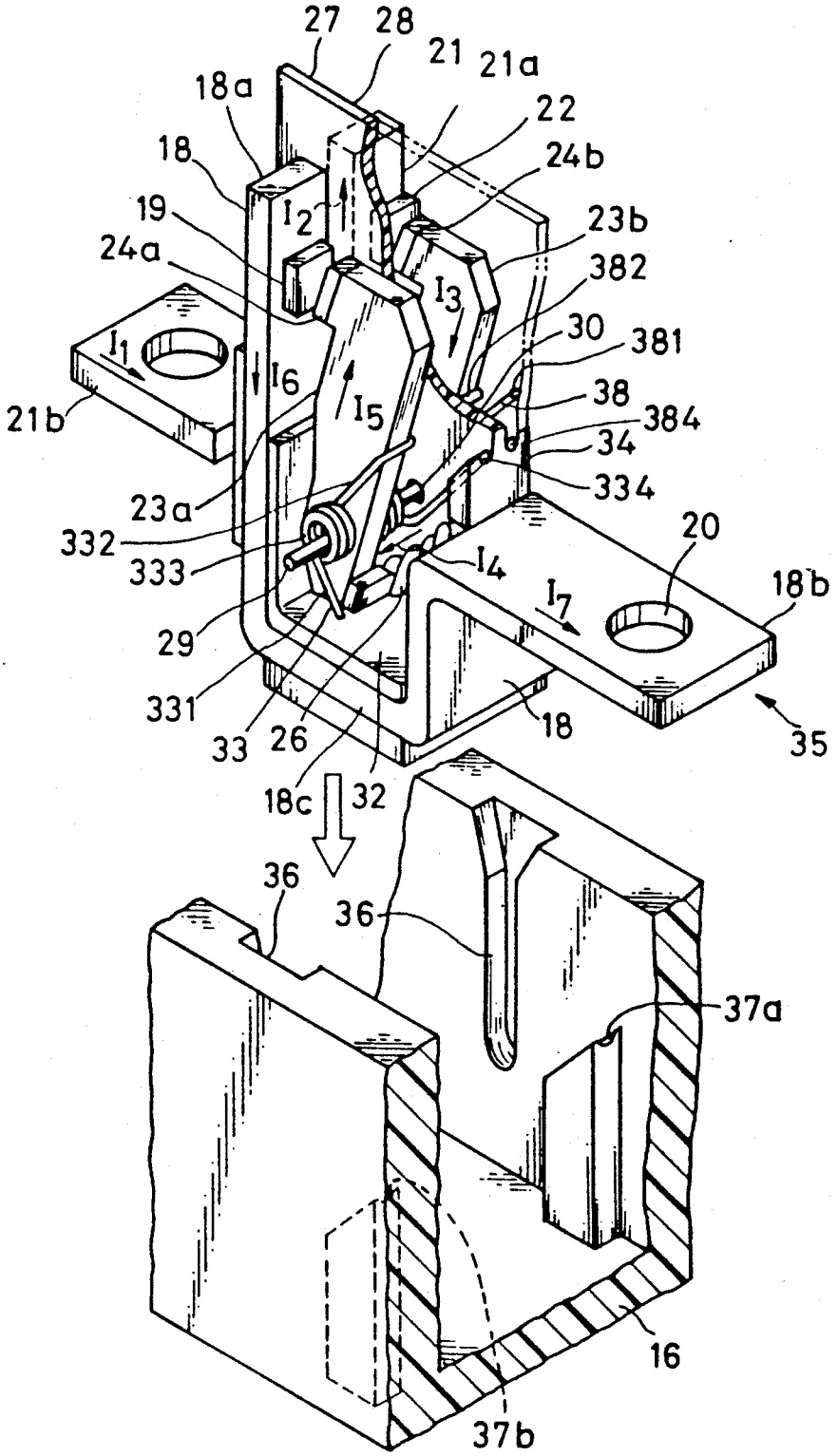
FIG. 4*a* is a perspective view showing main mechanical parts of the current limiting apparatus of a second embodiment of the present invention.
Figure 4B:
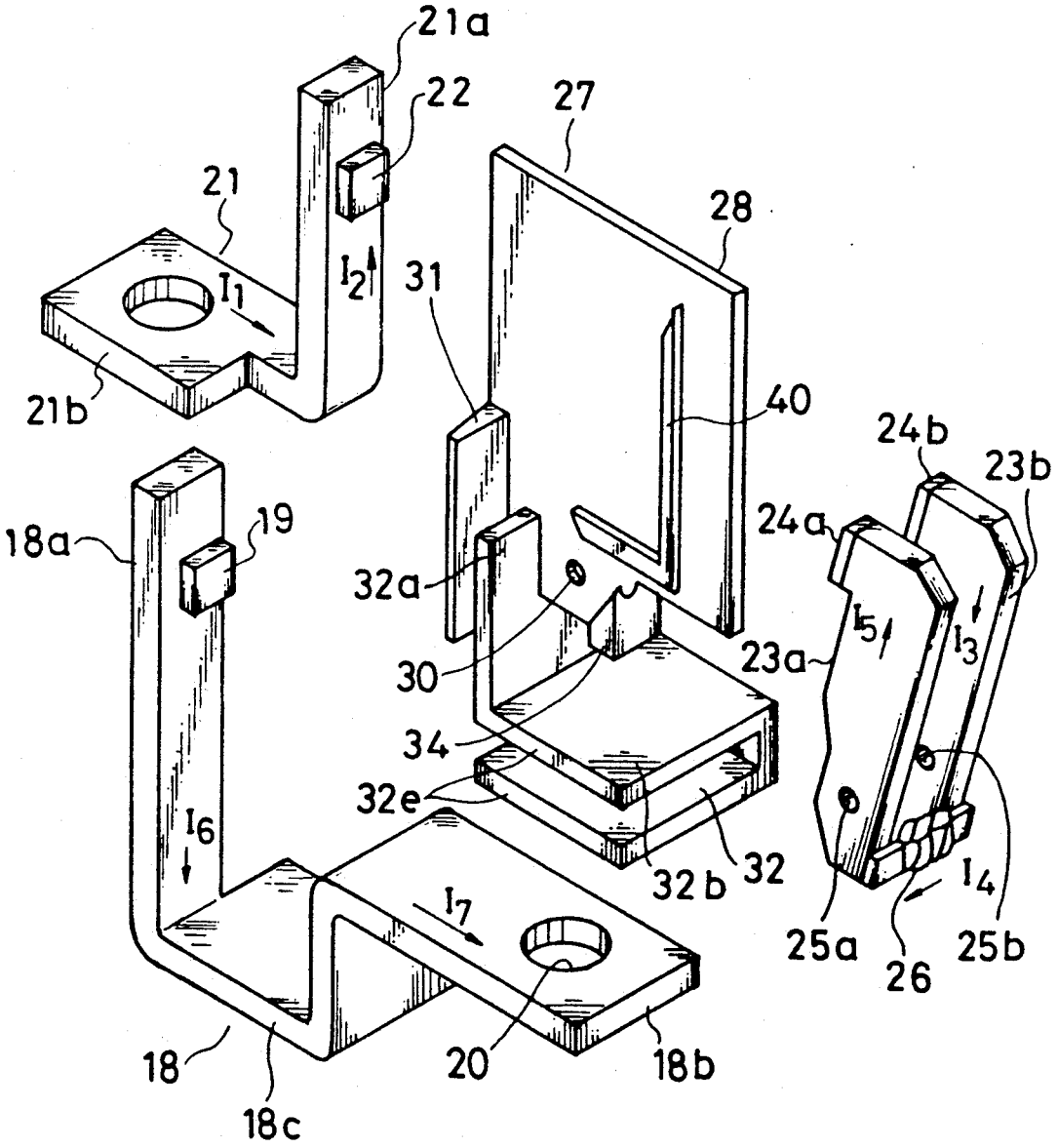
FIG. 4*b* is a perspective view showing the main mechanical parts of FIG. 4*a* taken all to pieces.

FIG. 4*a* is perspective view showing main mechanical parts of the current limiting apparatus of a second embodiment, and FIG. 4*b* is a perspective view taken all of the current limiting unit 35 in FIG. 4*a* to pieces. Corresponding parts and components to the first embodiment are shown by the same numerals and marks, and the description thereon made in the first embodiment similarly applies. Differences and features of this second embodiment from the first embodiment are as follows. In FIG. 4*a*, the movable contact arm 23*a* is disposed to oppose to the first stationary contact arm 18*a*, and the movable contact arm 23*b* is disposed to oppose to the second stationary contact arm 21*a*. That is, partner conductors in contact of the movable contact arms 23*a* and 23*b* are reversed in comparison with their arrangement of the first embodiment. This is caused by differences in turning up positions of the stationary contact arms 18*a* and 21*a* of FIG. 4*b* from those of FIG. 4.

In FIG. 4*a*, a current passage in the closed state is from the second stationary conductor 21 to the first stationary conductor 18 through the second stationary contact arm 21*a*, the first movable contact arm 23*b*, the flexible copper-stranded wire 26 the second movable contact arm 23*a* and the first stationary contact arm 18*a* in this order. At that time, since direction of a current $I_3$ flowing through the first movable contact arm 23*b* and direction of a current $I_2$ flowing through the second stationary contact arm 21*a* are opposite to each other, electromagnetic repulsion acts on these contact arms 23*b* and 21*a* to each other. In a normal current level, this electromagnetic repulsion is weaker than a biasing force of the torsion spring 38, thereby holding the movable contact 24*b* in contact with the stationary contact 22. Similarly, since direction of a current $I_5$ flowing through the second movable contact arm 23*a* and direction of a current $I_6$ flowing through the first stationary contact arm 18*a* are opposite to each other, electromagnetic repulsion acts on these contact arms 23*a* and 18*a* to each other. In a normal current level, this electromagnetic repulsion is weaker than a spring force of the torsion spring 33, thereby holding the movable contact 24*a* in contact with the stationary contact 19. Opening motions of the movable contact arms 23*a* and 23*b* at the time when a flowing current exceeds a predetermined value is quite similar to that of the first embodiment.

Figure 6:
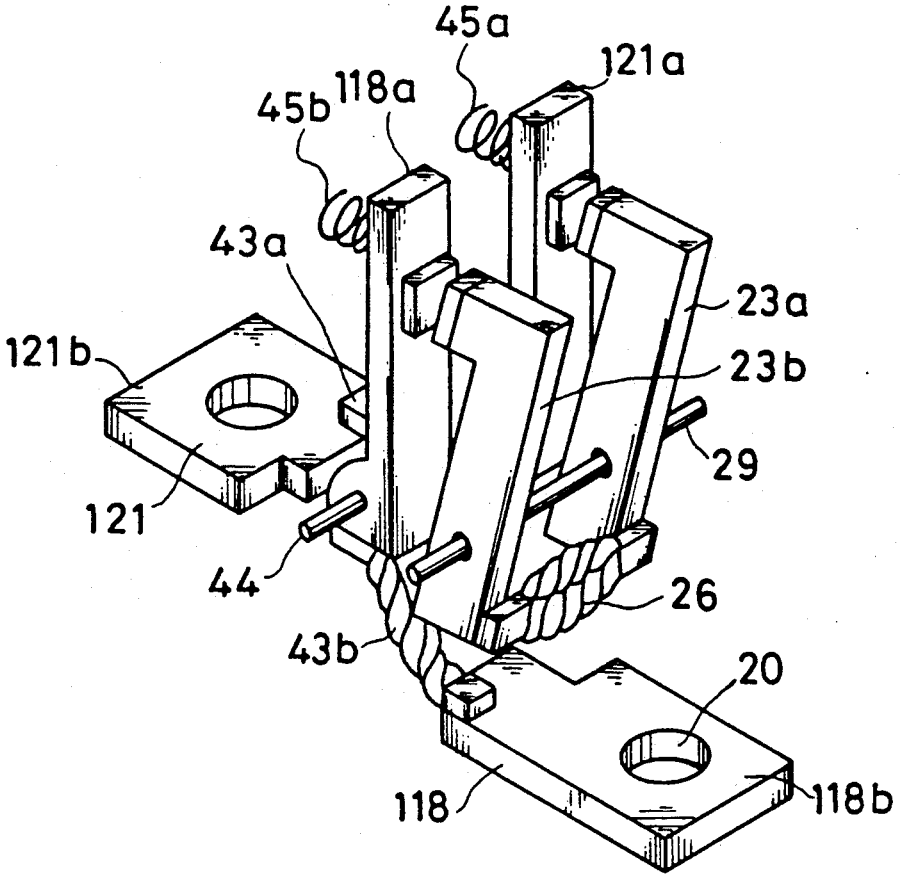
FIG. 6 is a perspective view showing a main part of the current limiting apparatus of a third embodiment of the present invention.

FIG. 6 is a perspective view showing a main part (partially omitted) of the current limiting apparatus of a third embodiment. Corresponding parts and components to the first embodiment are shown by the same numerals and marks, and the description thereon made in the first embodiment similarly applies. Differences and features of this third embodiment from the first embodiment are as follows. In this embodiment, a first stationary conductor 118 is divided into a connecting conductor 118*b* and a stationary contact arm 118*a*. The connecting conductor 118*b* is connected to the stationary contact arm 118*a* via a flexible copper-stranded wire 43*b*. Similarly, a second stationary conductor 121 consists of a connecting conductor 121*b* and a stationary contact arm 121*a* which are connected to each other via a flexible copper-stranded wire 43*a*. Both the stationary contact arms 118*a* and 121*a* are pivotally held by a pin 44 and urged to give contacting pressures to the movable contact arms 23*b* and 23*a* by a pair of springs 45*b* and 45*a*, respectively. When the shortcircuit occurs, both the stationary (it is not "stationary" in a strict sense of the word) contact arms 118*a* and 121*a* receive the electromagnetic repulsions, thereby detaching themselves from the movable contact arms 23*b* and 23*a*, respectively. Current limiting ability is thus improved further.

Figure 7:
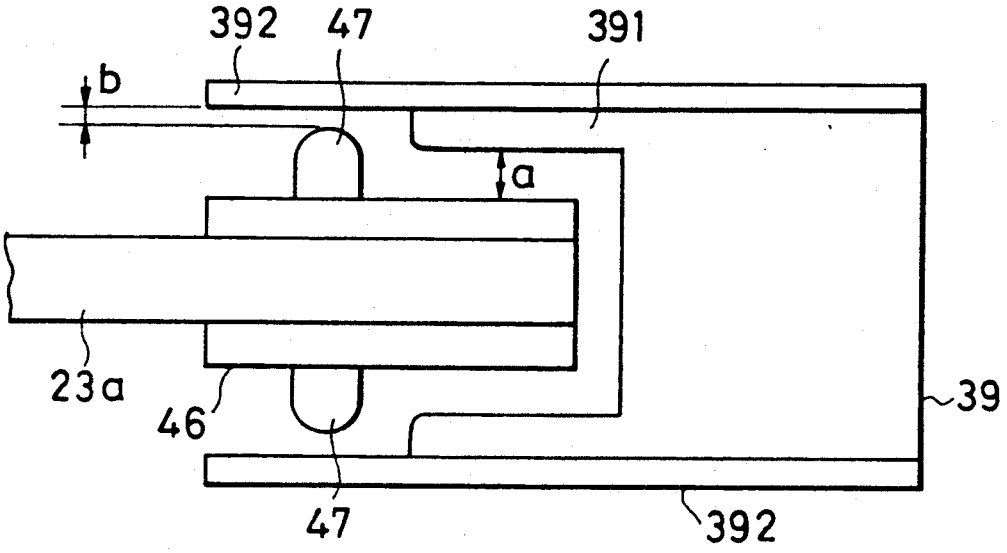
FIG. 7 is a front view showing a detailed construction only around an arc-extinguishing unit 39 in accordance with fourth embodiment of the present invention.

FIG. 7 is a front view showing a detailed construction only around the arc-extinguishing unit 39 in accordance with fourth embodiment of the present invention. The parts other than the illustration of FIG. 7 are similar to those of the first embodiment. In FIG. 7, the arc-extinguishing unit 39 is composed of plural cooling sheets 391, each having a substantially U-shaped cutout, and a pair of side wall plates 392. The cooling sheets 391 are aligned with a gap formed therebetween and held by the side wall plates 392. Both side walls of an end part of the movable contact arm 23*a* are covered with a pair of insulating guards 46. Each of this insulating guards 46 has an insulating projection 47 whose end part is rounded. The insulating projection 47 and the insulating guard 46 are generally formed by integrally molding an insulating material such as polyester resin. In the normal position of the movable contact arm 23*a*, a gap "b" between the side wall plate 392 and the insulating projection 47 is made smaller than a gap "a" between the cooling sheet 391 and the insulating guard 46. Even when the insulating projection 47 makes contact with the side wall plate 392 owing to the swinging motion of the movable contact arm 23*a* during the opening operation, the movable contact arm 23*a* makes a smooth opening motion with a small slide-friction between a spot on the insulating projection 47 and the side wall plate 392. Therefore, the swinging motion of the movable contact arm 23*a* is limited within a range of "b", and the insulating guard 46 does not make contact with the cooling sheets 391. Since the minimum value of "a" is always secured by presence of the insulating projection 47, its value can be made as small as possible.

Figure 8:
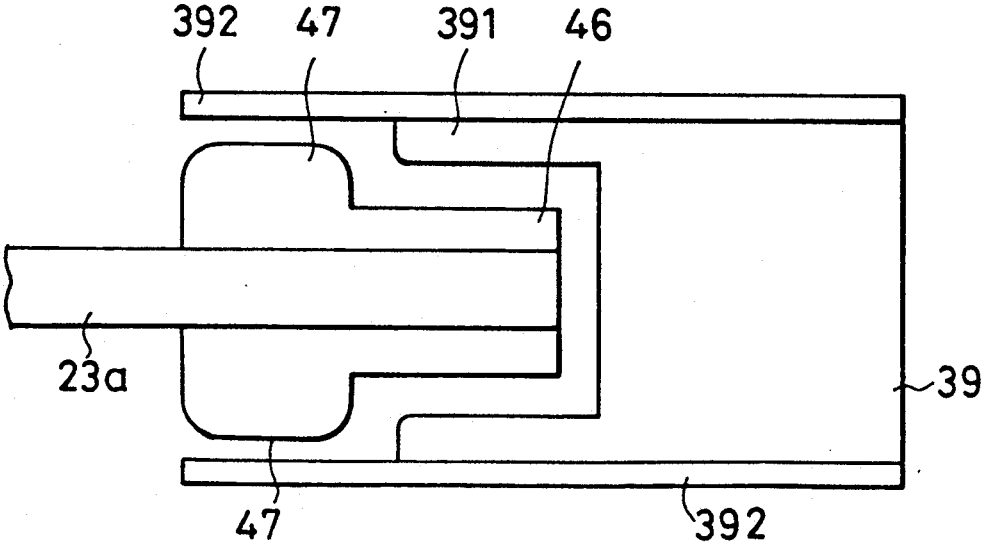
FIG. 8 is a front view showing a detailed construction only around an arc-extinguishing unit 39 in accordance with fifth embodiment of the present invention.

FIG. 8 is a front view showing a variety of the parts shown in FIG. 7. A difference of this fifth embodiment from the above-mentioned third embodiment is that the insulating projection 47 has a plane end part and a round edge. Operational functions of this insulating projection 47 in FIG. 8 is the same as that in FIG. 7.

In FIG. 7 and FIG. 8, the insulating guard 46 and the insulating projection 47 can be assembled into one body after completion of making them separately from each other.

Figure 9:
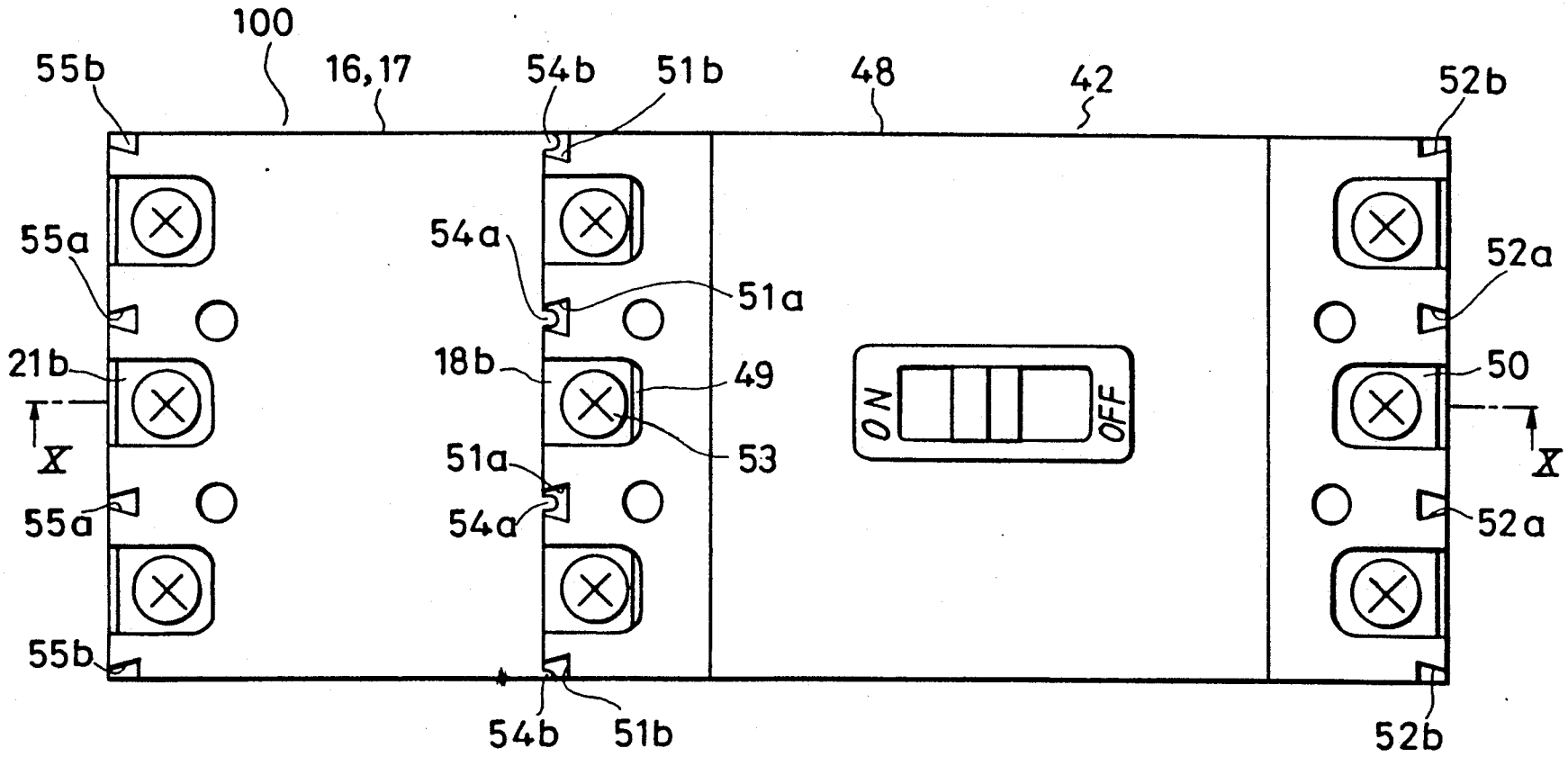
FIG. 9 is a front view showing the current limiting apparatus 100 coupled with a circuit breaker 42.
Figure 10:
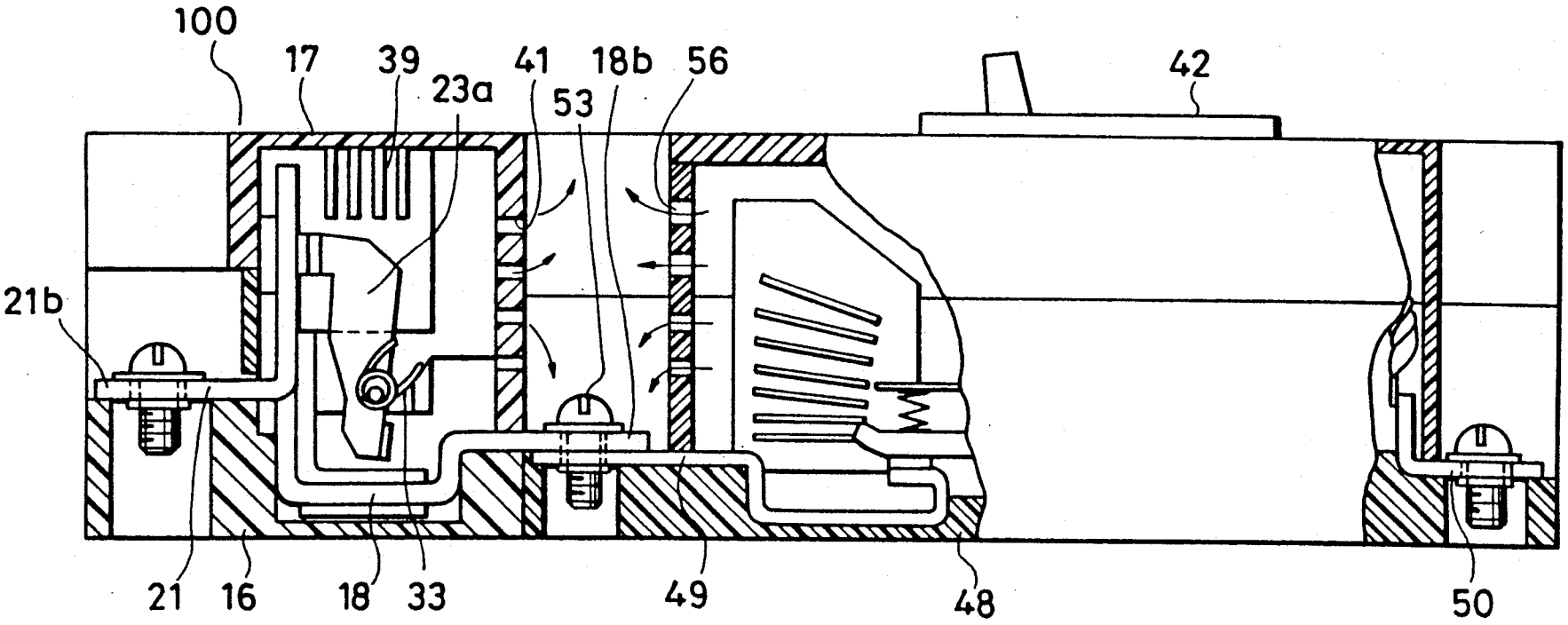
FIG. 10 is a cross-sectional side view showing the current limiting apparatus 100 and the circuit breaker 42 taken on line X—X in FIG. 9.
Figure 11:
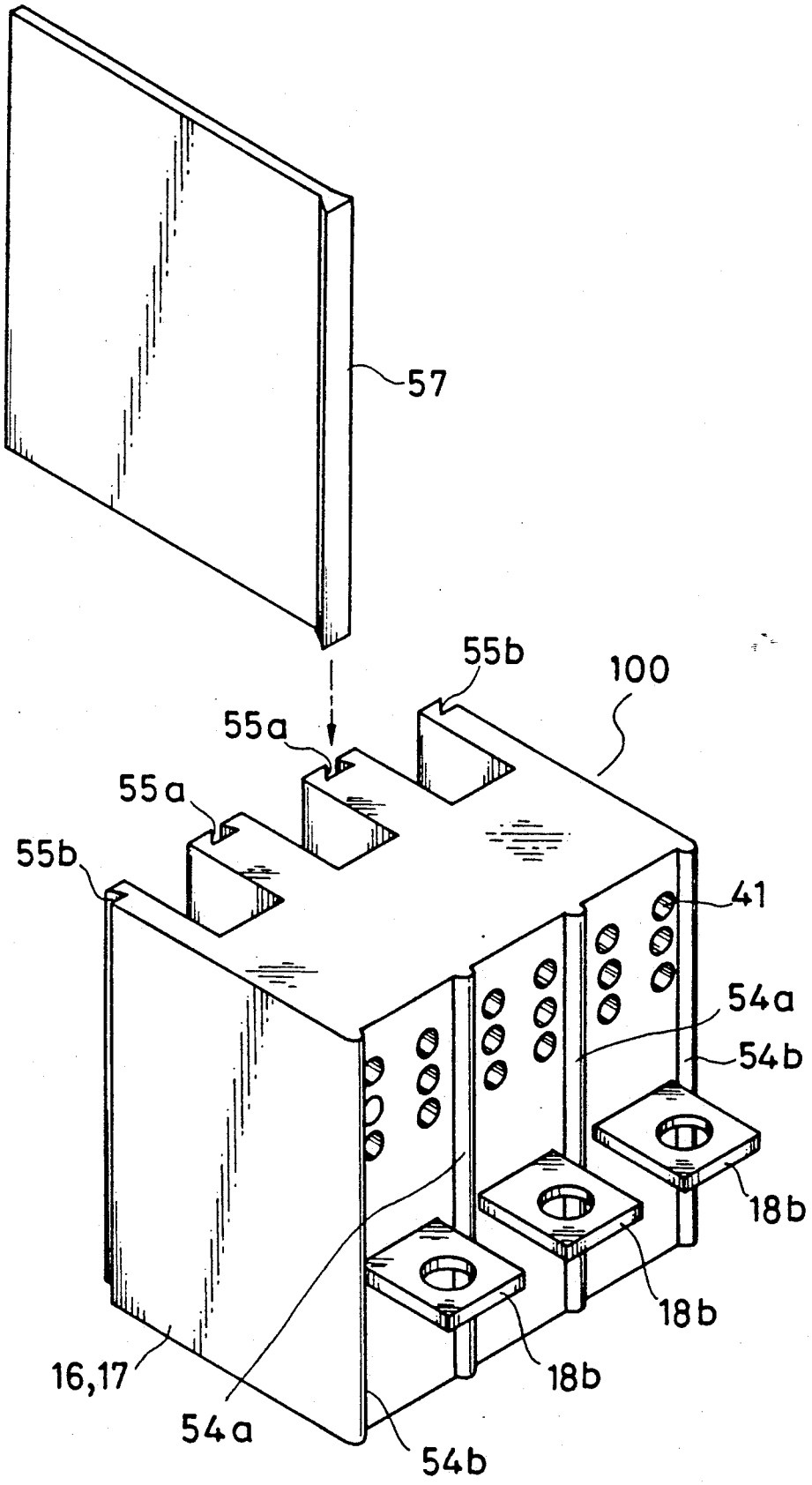
FIG. 11 is a perspective view showing the current limiting apparatus 100 and an insulating barrier 57.

Next, an application of the aforementioned current limiting apparatus, in which the above-mentioned current limiting apparatus is coupled with the circuit breaker 42, is described with reference to FIGS. 9–11. In FIG. 9, a casing 48 of the circuit breaker 42 has four grooves 51*b*/52*b*, 51*a*/52*a*, 51*a*/52*a* and 51*b*/52*b* in both end part where terminals 49 or 50 are provided. In FIG. 10, the connecting arm 18*b* of the current limiting apparatus 100 is fixed on the terminal 49 of the circuit breaker 42 by screws 53. In FIG. 9 or FIG. 11, four ribs 54*b*, 54*a*, 54*a* and 54*b* are formed at an end wall of the casing 16 (and the cover 17) of the current limiting apparatus 100. Two ribs 54*a* and 54*a* at inside are engaged with grooves 51*a* and 51*a* of the circuit breaker 42, respectively. The other ribs 54*b* and 54*b* at outside are engaged with the grooves 51*b* and 51*b*, respectively. Four grooves 55*b*, 55*a*, 55*a* and 55*b* are formed in an end wall of the casing 16 and the cover 17. Shapes of these grooves 55*a* and 55*b* are the same as those of the grooves 52*a* and 52*b*, respectively. In FIG. 10, plural holes 56 is formed in the casing 48 of the circuit breaker 42 in order to exhaust the arc gas out of the casing 48.

By inserting an insulating barrier 57 into the groove 55*a* as shown in FIG. 11, adjacent two conductors (not shown), which are to be connected to the current limiting apparatus 100 across the insulating barrier 57, are surely insulated from each other. When the plural current limiting apparatuses 100 are arranged closely together, the half size groove 55*b* constitutes a complete groove having the same shape as that of the groove 55*a* together with the adjacent half groove 55*b* of the next current limiting apparatus. The insulating barrier 57 can thereby be inserted into the mutually opposing grooves 51*b* and 51*b*. Enhancement of insulation between the first phase conductor (not shown) and the third phase conductor (not shown) of the next current limiting apparatus is thus secured by the insulating barrier 57. As to the circuit breaker 42 (FIG. 9), the grooves 51*b*, 51*a*, 52*b* and 52*a*, which are for holding the insulation barrier 57, are the conventional standard provisions. By utilizing these grooves 51*b*, 51*a*, 51*a* and 51*b* of the circuit breaker 42, four ribs 54*b*, 54*a*, 54*a* and 54*b* are engaged.

In FIG. 10, the current limiting apparatus 100 is coupled to the circuit breaker 42 from the longitudinal direction of the circuit breaker 42, and the height of the current limiting apparatus 100 is equal to or lower than that of the circuit breaker 42. Therefore, it is not necessary to enlarge a switchboard panel (not shown) in the direction of "height". This construction of the current limiting apparatus renders the installment of the current limiting apparatus easy in case the current limiting apparatus is newly added to the existing switchboard panel.

Figure 12:
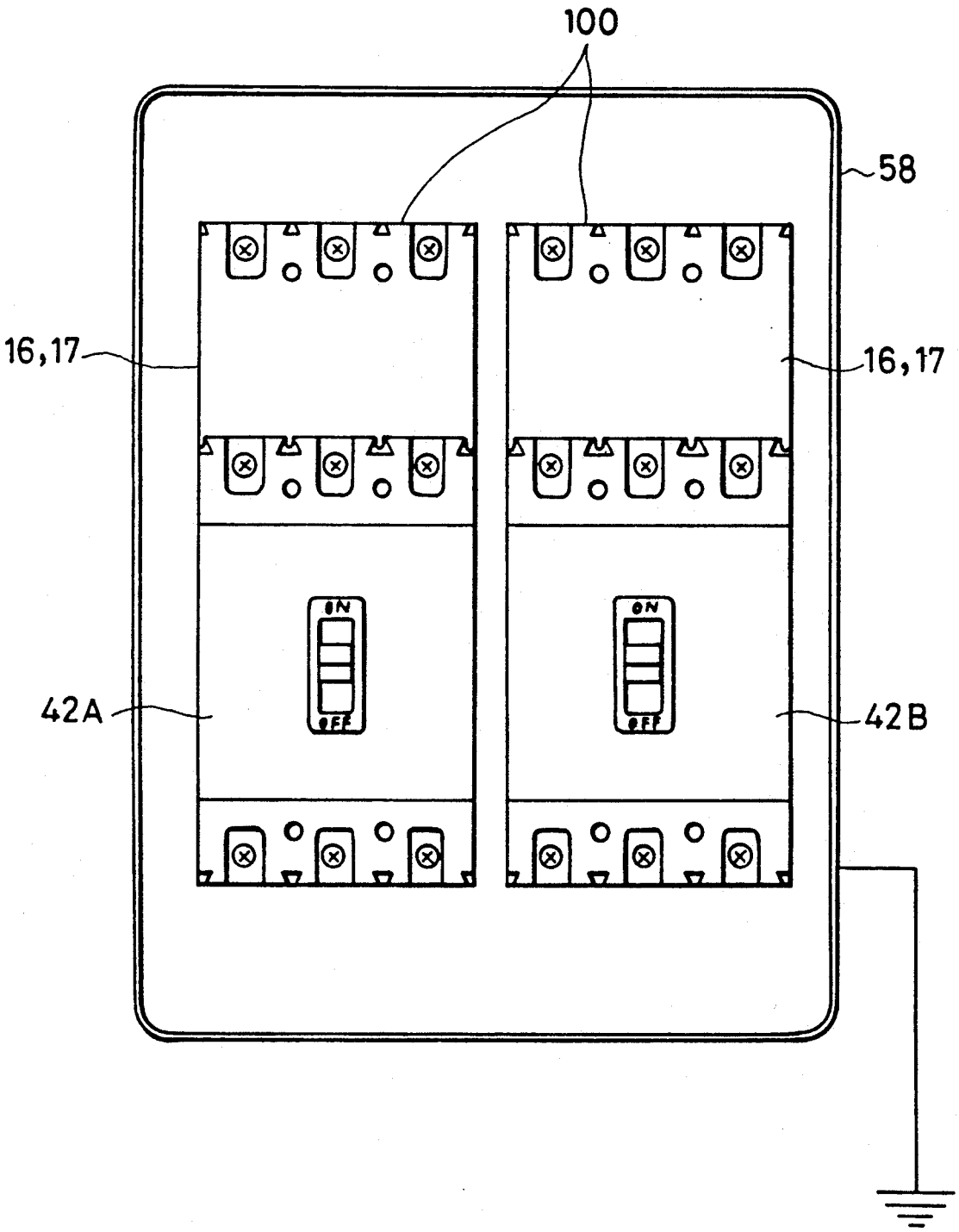
FIG. 12 is a front view showing two current limiting apparatuses 100 mounted in a switchboard panel 58.

Hereupon, the conductive hot gas produced by the arc, which is generated in the circuit breaker 42 or the current limiting apparatus 100, is exhausted out of the casing 16 (and the cover 17) or the casing 48 through the plural holes 41 or 56 and minute gaps (not shown) in the casings 16 and 18 etc. In general, the exhausting holes are formed at the longitudinal end wall part of the casings. Therefore, there has been a fear that the conductive hot gas, which is exhausted through the exhausting holes and leaks out through the minute gaps, is liable to stagnate around the connecting arm 18*b*. As a result, dielectric breakdown is induced, and it often develops to the failure of breaking. As shown in FIG. 12, since the switchboard panel 58 generally contains plural circuit breakers 42A and 42B, the dielectric breakdown among the above-mentioned connecting arm 18*b* and the neighboring conductors of the circuit breakers 42A and 42B or the current limiting apparatuses 100 is induced by the hot gas. This results in an accident that the breaking action is not completed and the accident spreads to another electric line. Moreover, since the switchboard panel 58 is grounded for safety, dielectric breakdown (earth fault) between the switchboard panel 58 and the nearest conductor occurs.

The above-mentioned unsolved problems hitherto has made it substantially impossible to arrange the current limiting apparatus 100 in the direction longitudinal of the circuit breaker 42A or 42B. However, according to the above-mentioned embodiment, since the insulating ribs 54*a* and 54*b* (FIG.9) are directly engaged with the grooves 51*a* and 51*b* of the circuit breaker 42, insulation between the connecting conductors 18*b*, insulation between the connecting conductors 18*b* and the neighboring conductors of two current limiting apparatuses or the circuit breakers, and insulation between the connecting conductors 18*b* and the nearest part of the switchboard panel 58 (FIG.12) are enhanced, thereby eliminating the aforementioned failure of breaking, spreading of fault to another electric line and the earth fault.

Figure 13:
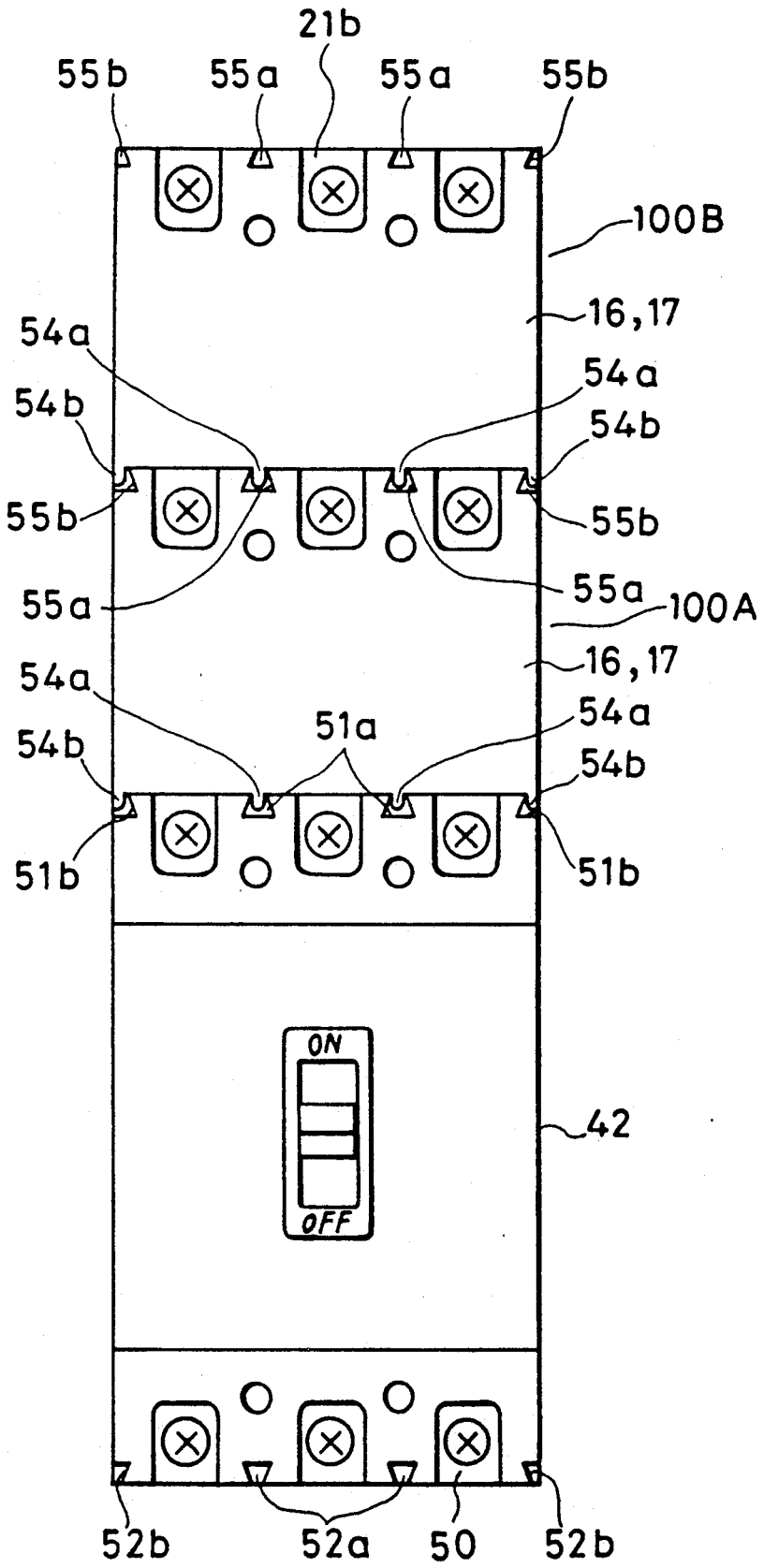
FIG. 13 is a front view showing two current limiting apparatuses 100A and 100B and the circuit breaker 42 coupled one another.
Figure 14:
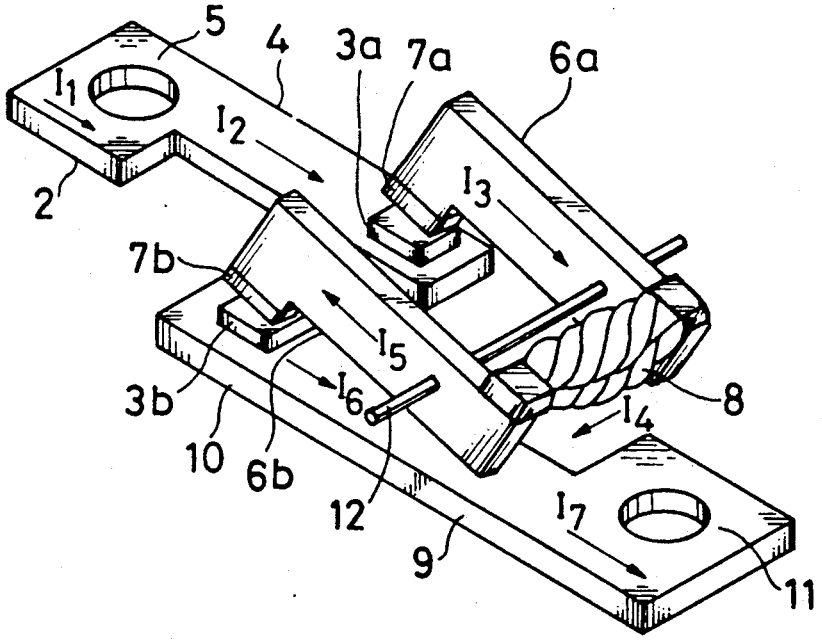
FIG. 14 (Prior Art)
FIG. 14 and FIG. 15 are perspective views showing the conventional current limiting apparatus.
Figure 15:
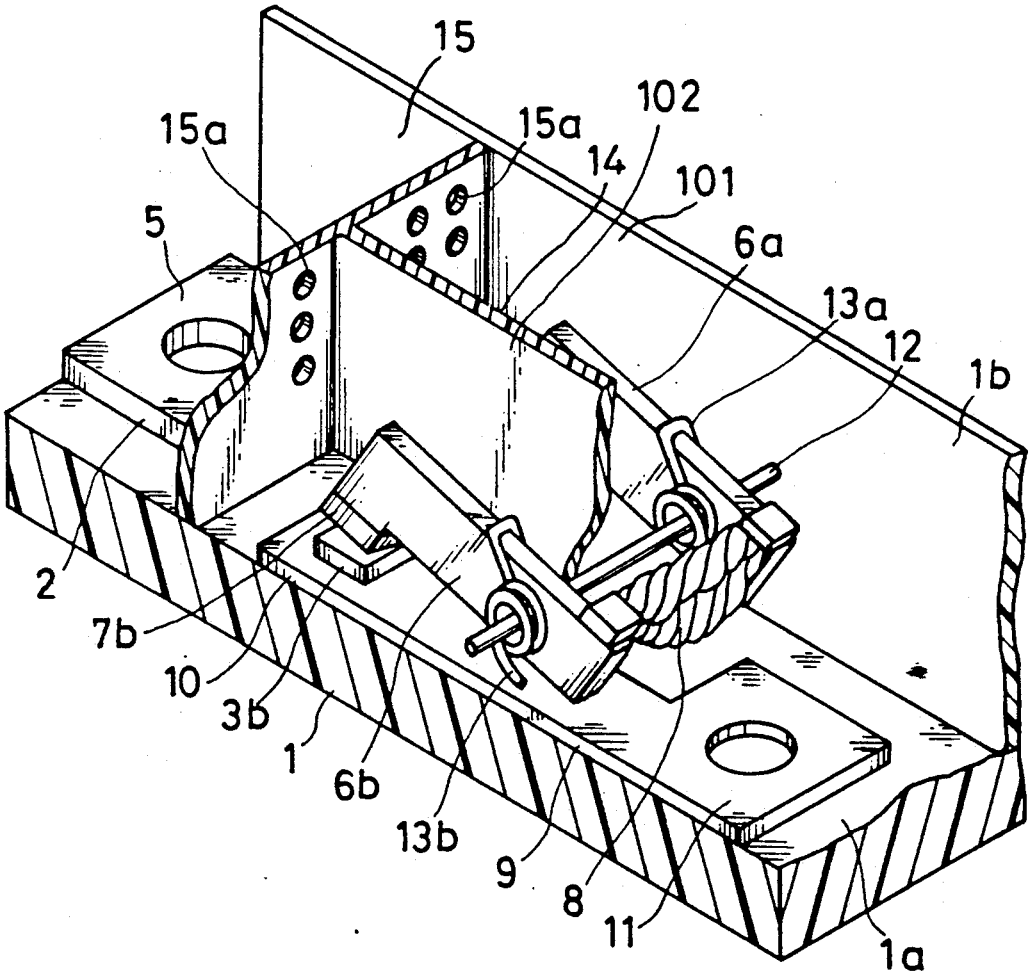
FIG. 15 (Prior Art)

FIG.13 is a front view showing the circuit breaker 42 to which two current limiting apparatuses 100A and 100B are coupled. The second current limiting apparatus 100B is coupled with the first current limiting apparatus 100A in the similar way to that the current limiting apparatus 100A is coupled with the circuit breaker 42. Thus, current limiting ability is strengthened by coupling plural current limiting apparatuses. By providing the insulating barriers 57 with the grooves 55*b* and 55*a* as well as the grooves 52*b* ad 52*a*, insulation among the conductors 21*b* (FIG.10) and that among the conductors 50 are enhancible.

Apart from the above-mentioned embodiment wherein the insulating ribs 54*a* and 54*b* are integrally mold together with both the casing 16 and the cover 17 of the current limiting apparatus 100, another embodiment may be such that an insulating plate is fixed in a groove formed in the casing 16 and the cover 17.

Furthermore, the current limiting apparatus can be coupled with another electric apparatus such as an electromagnetic switch.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A current limiting apparatus, comprising:

a casing;

a first stationary contact arm which is fixedly mounted in said casing and has a first stationary contact;

a first movable contact arm which is pivotally mounted in said casing and has a first movable contact, said first movable contact arm being urged to press said first movable contact against said first stationary contact, said first movable contact arm extending substantially parallel with said first stationary contact arm alongside a length of said first stationary contact arm which extends from said first stationary contact to a portion of said first stationary contact arm remote from said first stationary contact;

a second stationary contact arm which is fixedly mounted in said casing and has a second stationary contact; and a second movable contact arm which is pivotally mounted in said casing and has a second movable contact, said second movable contact arm being urged to press said second movable contact against said second stationary contact, said second movable contact arm extending substantially parallel with said second stationary contact arm alongside a length of said second stationary contact arm which extends from said second stationary contact to a portion of said second stationary contact arm remote from said second stationary contact, said second movable contact arm being electrically connected in series with said first movable contact arm.

2. A current limiting apparatus, comprising:

a casing;

a first stationary contact arm which is fixedly mounted in said casing and has a first stationary contact;

a first movable contact arm which is pivotally mounted in said casing and has a first movable contact, said first movable contact arm being urged to press said first movable contact against said first stationary contact and extending substantially parallel with and along said first stationary contact arm;

a second stationary contact arm which is fixedly mounted in said casing and has a second stationary contact; and a second movable contact arm which is pivotally mounted in said casing and has a second movable contact, said second movable contact arm being urged to press said second movable contact against said second stationary contact, extending substantially parallel with and along said second stationary contact arm, and being electrically connected in series with said first movable contact arm, wherein both of said movable contact arms are disposed substantially perpendicular to a base of said casing.

3. A current limiting apparatus in accordance with claim 1, wherein both of said stationary contact arms stand next to each other across an insulating partition, and both of said movable contact arms stand next to each other across said insulating partition.

4. A current limiting apparatus in accordance with claim 1, wherein plural holes for exhausting hot gas caused by an arc are formed in said casing at a position behind said moveable contact arms.

5. A current limiting apparatus, comprising:

a casing;

a first stationary contact arm which is fixedly mounted in said casing and has a first stationary contact;

a first movable contact arm which is pivotally mounted in said casing and has a first movable contact, said first movable contact arm being urged to press said first movable contact against said first stationary contact and extending substantially parallel with and along said first stationary contact arm;

a second stationary contact arm which is fixedly mounted in said casing and has a second stationary contact; and a second movable contact arm which is pivotally mounted in said casing and has a second movable contact, said second movable contact arm being urged to press said second movable contact against said second stationary contact, extending substantially parallel with and along said second stationary contact arm, and being electrically connected in series with said first movable contact arm, wherein both of said stationary contact arms stand next to each other across an insulating partition, and both of said movable contact arms stand next to each other across said insulating partition, and wherein said movable contact arms are pivotally held by a pin, both ends of said pin being held by journals formed in said casing and an intermediate part of said pin being held by said insulating partition.

6. A current limiting apparatus, comprising:

a casing;

a first stationary contact arm which is fixedly mounted in said casing and has a first stationary contact;

a first movable contact arm which is pivotally mounted in said casing and has a first movable contact, said first movable contact arm being urged to press said first movable contact against said first stationary contact and extending substantially parallel with and along said first stationary contact arm;

a second stationary contact arm which is fixedly mounted in said casing and has a second stationary contact; and a second movable contact arm which is pivotally mounted in said casing and has a second movable contact, said second movable contact arm being urged to press said second movable contact against said second stationary contact, extending substantially parallel with and along said second stationary contact arm, and being electrically connected in series with said first movable contact arm, wherein said first stationary contact arm is a part of a substantially L-shaped first stationary conductor, another part of which is a connecting arm for being connected to an external conductor, and wherein said current limiting apparatus further includes an insulating frame which is made of an insulating material and which includes an insulating partition arranged between said stationary contact arms and between said movable contact arms, said insulating frame having an engaging part for engagement with said first stationary conductor.

7. A current limiting apparatus in accordance with claim 5, further comprising:

an arc-extinguishing unit which includes plural cooling sheets and a pair of side wall plates for holding said plural cooling sheets; and at least a pair of insulating projections which are made of an insulating material and are provided on an end part of one of said movable contact arms to project toward each of said side wall plates with a predetermined gap formed between each of said insulating projections and each of said side wall plates.

8. A current limiting apparatus in accordance with claim 1, wherein said casing includes plural ribs of an insulating material on one outer end wall part thereof, and plural grooves into which said ribs closely fit.

* * * * *